US008453301B1

(12) United States Patent
McCoy

(10) Patent No.: US 8,453,301 B1
(45) Date of Patent: Jun. 4, 2013

(54) ZIPPER PULL TAB RETENTION DEVICE

(76) Inventor: Patty McCoy, Mount Holly, NJ (US)

( * ) Notice: Subject to any disclaimer, the term of this patent is extended or adjusted under 35 U.S.C. 154(b) by 305 days.

(21) Appl. No.: 12/841,208

(22) Filed: Jul. 22, 2010

(51) Int. Cl.
*A44B 19/30* (2006.01)

(52) U.S. Cl.
USPC ..... 24/429; 24/436

(58) Field of Classification Search
USPC ..... 24/429, 436, 419, 585.1, 585.11; 294/3.6
See application file for complete search history.

(56) References Cited

U.S. PATENT DOCUMENTS

| | | | | | |
|---|---|---|---|---|---|
| 3,292,224 | A | * | 12/1966 | Silberman | 24/419 |
| 3,335,586 | A | * | 8/1967 | Levine et al. | 70/68 |
| 3,579,749 | A | | 5/1971 | Holman | |
| 3,820,203 | A | * | 6/1974 | Takamatsu | 24/419 |
| 4,022,506 | A | * | 5/1977 | Cloud, Sr. | 294/3.6 |
| 4,244,086 | A | | 1/1981 | Gregg | |
| 4,271,567 | A | * | 6/1981 | Aoki | 24/421 |
| 4,287,646 | A | * | 9/1981 | Kanzaka | 24/424 |
| 4,368,562 | A | * | 1/1983 | Minami | 403/354 |
| 4,422,220 | A | * | 12/1983 | Oda | 24/421 |
| 4,756,173 | A | | 7/1988 | Yang | |
| 4,829,638 | A | * | 5/1989 | Ishii | 24/421 |
| 4,928,363 | A | | 5/1990 | Easton | |
| 4,974,297 | A | * | 12/1990 | Akashi | 24/429 |
| 4,982,479 | A | * | 1/1991 | Oda | 24/424 |
| 5,008,985 | A | | 4/1991 | Thompson | |
| 5,255,418 | A | * | 10/1993 | Chen | 24/424 |
| 5,611,121 | A | * | 3/1997 | Akeno et al. | 24/423 |
| 5,664,300 | A | * | 9/1997 | Mizuno | 24/424 |
| 5,694,667 | A | * | 12/1997 | Mizuno | 24/421 |
| 5,729,874 | A | * | 3/1998 | Mizuno | 24/429 |
| 5,884,373 | A | * | 3/1999 | Kawamura | 24/421 |
| 5,924,174 | A | * | 7/1999 | Mizuno | 24/421 |
| 5,956,819 | A | * | 9/1999 | Terasaki et al. | 24/432 |
| 5,996,188 | A | * | 12/1999 | Yaguramaki et al. | 24/424 |
| 6,082,030 | A | * | 7/2000 | Kesselring et al. | 40/307 |
| 6,332,249 | B1 | * | 12/2001 | Oda et al. | 24/421 |
| 6,701,584 | B2 | | 3/2004 | Metzger | |
| 6,769,156 | B1 | * | 8/2004 | Chen | 24/421 |
| 7,200,901 | B2 | | 4/2007 | Pitts et al. | |
| 7,207,092 | B2 | * | 4/2007 | Iwase et al. | 24/421 |
| 7,870,650 | B2 | * | 1/2011 | Keyaki et al. | 24/424 |
| 2003/0177617 | A1 | * | 9/2003 | Kita et al. | 24/415 |
| 2005/0050698 | A1 | * | 3/2005 | Muratsubaki et al. | 24/429 |
| 2009/0077775 | A1 | | 3/2009 | Burns et al. | |
| 2011/0041297 | A1 | * | 2/2011 | Iwase | 24/418 |

* cited by examiner

*Primary Examiner* — Robert J Sandy
*Assistant Examiner* — Rowland D Do
(74) *Attorney, Agent, or Firm* — Montgomery Patent & Design; Robert C. Montgomery

(57) ABSTRACT

A zipper pull tab retention device includes a pull tab cover and a fastening means. The pull tab cover comprises a durable friction fit cover which slides over an existing zipper pull tab. The fastening means includes a metal pin which is integrally attached to the pull tab cover. The pin is located on a surface of the pull tab cover which faces a user's chest. The pin engages the teeth of a zipper, thus allowing a user to press the pull tab cover against the zipper and prevent movement of a zipper pull tab until the pull tab cover is pulled away from the zipper.

3 Claims, 4 Drawing Sheets

ZIPPER PULL TAB RETENTION DEVICE

RELATED APPLICATIONS

The present invention was first described in a notarized Official Record of Invention on Sep. 21, 2009, that is on file at the offices of Montgomery Patent and Design, LLC, the entire disclosures of which are incorporated herein by reference.

FIELD OF THE INVENTION

The present invention relates generally to zipper-type closure assemblies, and in particular, to a device adapted to provide secure retention of a zipper pull tab against gravity when in an upright position.

BACKGROUND OF THE INVENTION

Zippers represent one of the most common systems for providing selectable closure to items such as bags, clothing, tents, and countless other protective or enclosing devices. Zipper devices are often seen as advantageous to other common fastening means such as laces, buttons, and snaps due to their ease of manipulation, quickness of use, and their ability to provide closure across a large area. Furthermore, zippers tend to be fairly durable of construction and often outlast the life of a garment or the like, unlike buttons and laces which are prone to failure.

One (1) problem associate with zippers is that they do not provide the same level of security as buttons and the like. Zippers are particularly prone to coming inadvertently undone during use. This is especially a problem with vertically oriented zippers where gravity itself can be enough to cause the pull tab to fall downward and undo the zipper. This can lead to undesirable situations such as the accidental opening of a zipper doorway enclosure such as on a tent, accidental opening of a bag or other carrying device which results in spillage of the contents, and the particularly common and embarrassing situation of accidental opening of a front zipper portion such as commonly found on pants and shorts.

Various attempts have been made to provide zipper pull tab retainers. Examples of these attempts can be seen by reference to several U.S. Pat. No. 3,579,749, issued in the name of Holman, describes a zipper safety fastener which includes a toggling interlocking fastener integral to the zipper pull tab assembly for providing selective motion prevention functions to the zipper.

U.S. Pat. No. 4,928,363, issued in the name of Easton, describes a zipper securing ring which comprises a pull tab with a large circular aperture designed to fit over a common top button portion of pants or the like. The Easton device allows a user to hang the zipper over the button prior to securing the button in order to prevent accidental downward motioning of the zipper pull tab.

U.S. Pat. No. 7,200,901, issued in the name of Pitts et al., describes a zipper securing device including multiple embodiments of two-part zipper and elastic band assemblies which engage each other to inhibit accidental movement of the zipper pull.

While these devices fulfill their respective, particular objectives, each of these references suffer from one (1) or more of the aforementioned disadvantages. Many such devices are bulky or otherwise unpleasing in shape and appearance as compared to a conventional zipper pull tab. Furthermore, many such devices make motioning of the zipper inconvenient as compared to a conventional zipper assembly. In addition, many such devices are not retrofittable to an existing zipper assembly and thus cannot be utilized with existing clothing or other items with zippers. Accordingly, there exists a need for a zipper pull tab retention device without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide secure retention to an existing zipper assembly in a manner which does not encroach upon the primary features of ease of manipulation of conventional zippers and which does not provide diminished aesthetic or comfort features. Thus, the object of the present invention is to solve the aforementioned disadvantages and provide for this need.

To achieve the above objectives, it is an object of the present invention to prohibit the inadvertent opening of a zipper assembly.

Another object of the present invention is to provide features of security to existing zipper pull tabs in a retrofittable manner. The device comprises a sheathing which fits snuggly over a conventional zipper pull tab and an integral pin which protrudes from a back exterior portion of the sheathing.

Yet still another object of the present invention is to allow a user to selectively and easily provide a securing function to the zipper tab by engaging the pin with teeth of the existing zipper assembly to prevent vertical movement of the device.

Yet still another object of the present invention is to provide an unobtrusive aesthetic appearance and shape to the zipper assembly by disposing the pin on the backside of the sheathing. The sheathing may further be manufactured in various colors and sizes to provide a coordinated aesthetic appearance and size to a variety of existing zipper pull tabs.

Yet still another object of the present invention is to allow a zipper assembly to function in the manner of a conventional zipper assembly when provided with the device. The pin may be easily disengaged by pulling forward on the zipper tab, allowing the device to function in a normal manner.

Yet still another object of the present invention is to allow for simple removal, replacement, and reuse of the device via the friction fit fastening of the sheathing to an existing zipper pull tab. The device may be easily removed without damaging the zipper pull tab, allowing the zipper pull tab to be used as originally prior to application of the device and allowing the device to be utilized on other zipper assemblies as desired.

Yet still another object of the present invention is to provide a method of utilizing the device that provides a unique means of obtaining an instance of the device of a desired size and aesthetic appearance, placing the sheathing over an existing zipper pull tab, motioning the zipper assembly in a conventional manner with the device in place, selectively engaging the pin with the teeth of the existing zipper assembly to provide security against accidental motioning of the pull tab, providing an unobtrusive appearance as compared to a conventional zipper assembly, easily disengaging the pin for subsequent motioning of the zipper assembly in a conventional manner, and easily removing, replacing, or reusing the device as desired.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | zipper pull tab retention device |
| 14 | zipper |
| 15 | puller |
| 16 | teeth |
| 20 | sheathing |
| 21 | interior portion |
| 25 | pin |
| 26 | hook |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
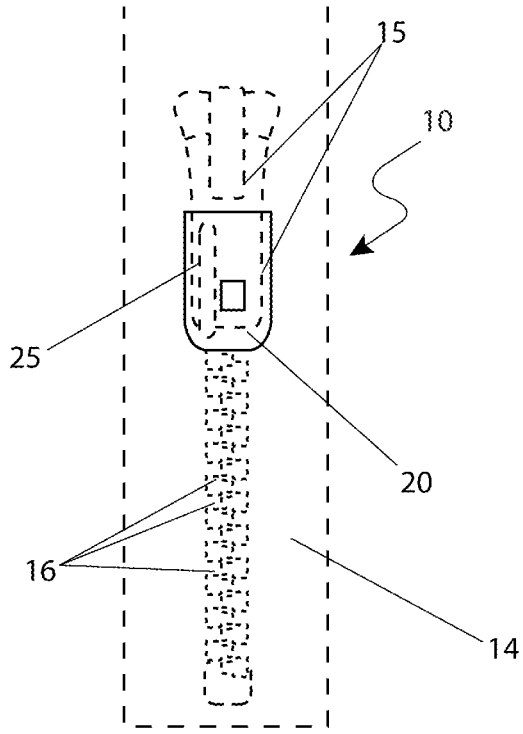
FIG. 1 is an environmental view of a zipper pull tab retention device 10, according to a preferred embodiment of the present invention.

The present invention describes a zipper pull tab retention device (herein described as the "device") 10, which provides a means for prohibiting inadvertently opened zippers 14. Referring now to FIG. 1, an environmental view of the device 10, according to the preferred embodiment of the present invention, is disclosed. The device 10 encompasses a puller 15 thereon an existing zipper 14 and engages the teeth 16 to eliminate the accidental descending of said puller 15 which disengages said teeth 16 and opens the zipper 14. The device 10 comprises a sheathing 20 and a pin 25. The device 10 is preferably manufactured in a variety of sizes to accommodate various zippers 14. The device 10 may also be manufactured in various colors or patterns to complement various wardrobes. The device 10 may be utilized on slacks, jeans, shorts, shirts, or similar items which comprise conventional zippers 14.

Figure 2:
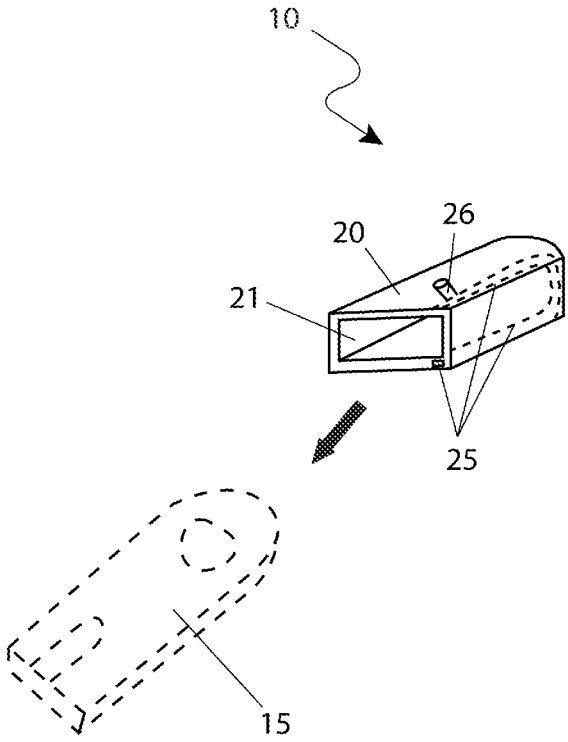
FIG. 2 is a perspective view of the zipper pull tab retention device 10, according to a preferred embodiment of the present invention.
Figure 3:
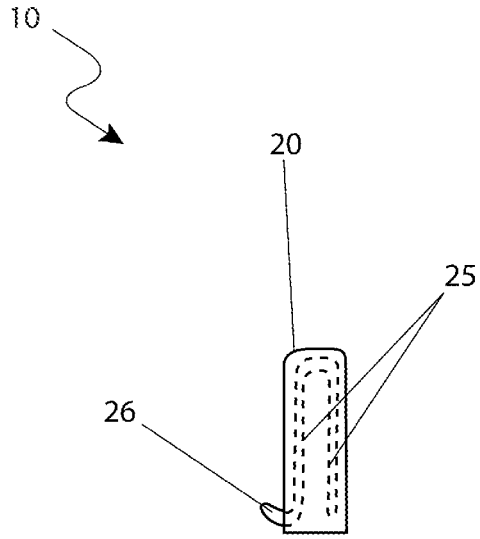
FIG. 3 is a side view of the zipper pull tab retention device 10, according to a preferred embodiment of the present invention; and, FIG. 4 is another side view of the zipper pull tab retention device 10 depicting placement in a plurality of teeth 16, according to a preferred embodiment of the present invention.
Figure 4:
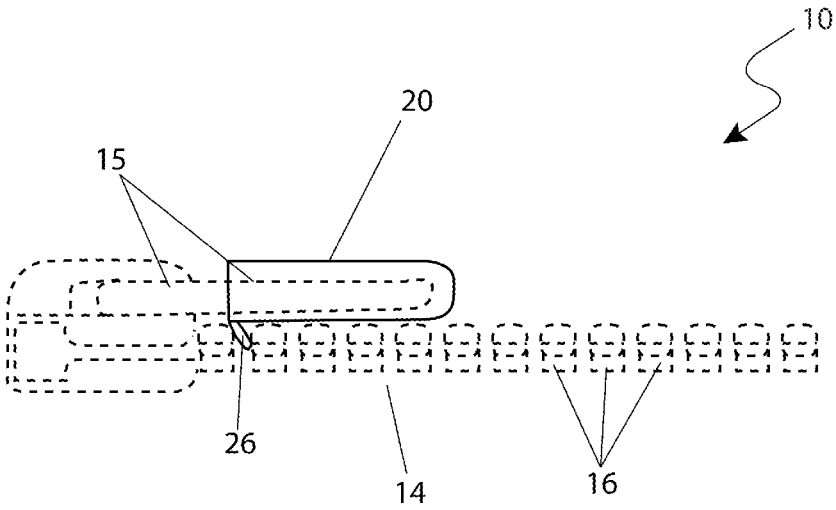

Referring now to FIG. 2, a perspective view of the device 10, FIG. 3, a side view of the device 10, and FIG. 4, another side view of the device 10 depicting placement in a plurality of teeth 16, according to the preferred embodiment of the present invention, are disclosed. The sheathing 20 takes on a generally "U"-shaped form comprising an interior portion 21. The interior portion 21 enables the puller 15 to be inserted via common friction fitting means. The sheathing 20 is fabricated from a rubber material, yet other materials may be utilized without limiting the scope of the device 10. The sheathing 20 encompasses the pin 25 which is utilized to engage the teeth 16 on the zipper 14. The pin 25 also comprises a "U"-shaped form which is integrally molded into the sheathing 20. The pin 25 comprises a hook 26 thereon a distal portion which protrudes from the sheathing 20 at an upward angle and engages a desired area between the teeth 16, thereby prohibiting the zipper 14 from any undesired descending. The pin 25 is fabricated from materials such as, but not limited to: wire, plastic, or the like.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: acquiring the device 10; fitting the sheathing 20 over a puller 15 of a zipper 14 with the hook 26 facing toward the teeth 16; zipping the zipper 14 via grasping the sheathing 20 and pulling said zipper 14 closed; enabling the hook 16 to be positioned between the teeth 16, thereby suspending the puller 15 and concurrently the sheathing 20 which further prohibits the puller 15 from descending to open the zipper 14; utilizing the device 10 as necessary; removing the device 10 as desired; and, being assured that the user's zipper 14 remains exactly as placed without worry.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A retention device for a pull tab of a zipper comprising a sheathing and a pin disposed within said sheathing;

wherein said sheathing removably engages said pull tab;

wherein said pin removably engages teeth of said zipper;

wherein said retention device provides a means for prohibiting said pull tab from inadvertently opening said zipper;

wherein said sheathing comprises a generally "U"-shaped body comprising an interior portion, a closed end, and an open end providing access to said interior portion;

wherein said pull tab is removably inserted within said interior portion and is secured therein;

wherein said sheathing further comprises a rubber construction;

wherein said pin further comprises a generally "U"-shaped member having a first portion integral to said sheathing and a hook portion extending outwardly through said sheathing;

wherein said hook portion engages said teeth of said zipper;

wherein said hook portion further extends outwardly and angles towards an open end of said sheathing;

wherein said pin further comprises a plastic construction;

wherein said "U"-shaped body of said sheathing further comprises a closed top wall, a closed bottom wall, a closed left wall and a closed right wall each extending along an entire longitudinal length of said sheathing;

wherein said first portion of said pin begins at said open end and extends along said closed bottom wall adjacent to said closed right wall; and wherein said pin further extends up said closed end and along said closed top wall wherein said hook portion of said pin exits out of said closed top wall and terminates exterior of said sheathing.

2. A retention device for a pull tab of a zipper comprising:

a sheathing comprising a generally "U"-shaped body comprising an interior portion, a closed end, and an open end providing access to said interior portion; and a pin comprising a generally "U"-shaped member having a first portion integral to said sheathing and a hook portion extending outwardly through said sheathing and angled toward said open end;

wherein said pull tab is removably inserted within said interior portion of said sheathing and is secured therein;

wherein said hook portion of said pin removably engages said teeth of said zipper;

wherein said retention device provides a means for prohibiting said pull tab from inadvertently opening said zipper;

wherein said sheathing further comprises a rubber construction;

wherein said pin further comprises a plastic construction; and wherein said pin is statically situated within said sheathing.

3. A method of preventing inadvertent descending of a zipper pull tab of a zipper, thereby unfastening said zipper, comprising the following steps:

providing a retention device further comprising:

a sheathing comprising a generally "U"-shaped body comprising an interior portion, a closed end, and an open end providing access to said interior portion; and a pin comprising a generally "U"-shaped member having a first portion integral to said sheathing and a hook portion extending outwardly through said sheathing and angled toward said open end;

fitting said sheathing over said pull tab and thereby securing said pull tab within, wherein said hook portion of said pin is oriented toward teeth of said zipper;

fastening said zipper by grasping said sheathing and said pull tab; and enabling said hook portion to be positioned between said teeth, thereby suspending said pull tab and said sheathing and further prohibiting said pull tab from descending to open said zipper;

wherein said sheathing further comprises a rubber construction;

wherein said pin further comprises a plastic construction; and wherein said pin is statically situated within said sheathing.

* * * * *